United States Patent [19]

Lantz

[11] Patent Number: 5,045,049

[45] Date of Patent: Sep. 3, 1991

[54] CENTRIFUGAL SEPARATOR

[75] Inventor: Christer Lantz, Stocksund, Sweden

[73] Assignee: Alfa-Laval Separation AB, Tumba, Sweden

[21] Appl. No.: 487,962

[22] PCT Filed: Oct. 3, 1989

[86] PCT No.: PCT/SE88/00541

§ 371 Date: May 14, 1990

§ 102(e) Date: May 14, 1990

[87] PCT Pub. No.: WO90/04461

PCT Pub. Date: May 3, 1990

[30] Foreign Application Priority Data

Oct. 17, 1988 [SE] Sweden ..... 8803687

[51] Int. Cl.[5] ..... B04B 1/08

[52] U.S. Cl. ..... 494/70

[58] Field of Search ..... 494/35, 57, 33, 70, 494/73, 68, 69, 71, 72, 74; 210/781, 782

[56] References Cited

U.S. PATENT DOCUMENTS

| | | | |
|---|---|---|---|
| 1,168,452 | 1/1916 | Anderson | 494/57 |
| 2,469,956 | 5/1949 | Fawcett | 494/70 |
| 2,500,100 | 3/1950 | Strezynski | 494/35 |
| 3,335,946 | 8/1967 | Putterlik | 494/73 |

*Primary Examiner*—Robert W. Jenkins

[57] ABSTRACT

In a centrifuge rotor a central inlet chamber (14) communicates with a surrounding separation chamber (5) through the spaces between the radially inner edge portions of at least partly conical separation discs (6) which are arranged in a stack in the separation chamber (5) coaxially with the rotor. Said inner edge portions of the separation discs are arranged gradually to entrain into the rotor rotation a liquid mixture supplied to the inlet chamber (14). At least some of the separation discs (6) have through holes (11) situated at a distance from their radially inner edges, that is smaller than the distance between the holes (11) and the radially outer edges of the separation discs, so that the mixture may be distributed axially over the whole stack of separation discs (6), before the real separation of the different mixture components starts in the spaces between the conical portions of the separation discs.

5 Claims, 3 Drawing Sheets

CENTRIFUGAL SEPARATOR

Figure 1:
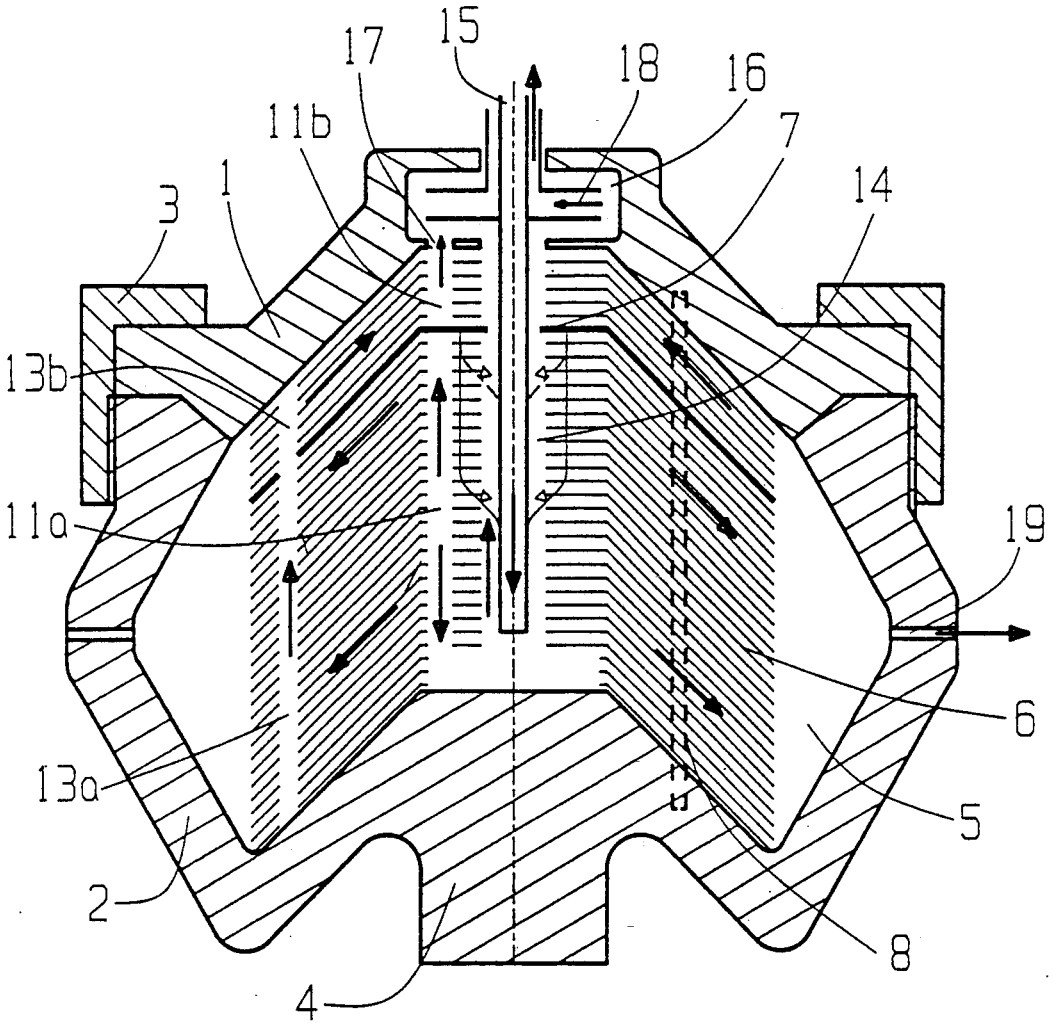

The present invention relates to a centrifugal separator comprising a rotor having a central inlet chamber for a liquid mixture of components to be separated and a separating chamber surrounding the inlet chamber and containing a stack of at least partly conical separation discs arranged axially spaced from each other and coaxially with the rotor and having radially inner and outer edges, the spaces between the separation discs having inlets for mixture at the radially inner edges of the separation discs, which inlets communicate with said inlet chamber, and outlets for separated components radially outside the inlets, so that mixture as well as components separated therefrom are allowed to flow radially outwards between the separation discs during the operation of the rotor.

A centrifugal separator of this kind is shown for instance in U.S. Pat. No. 2,488,747. In this known centrifugal separator the centrifuge rotor forms a lower separation chamber of the kind described above and an upper separation chamber which communicates with the former one radially outside the separation discs. The upper separation chamber is arranged for further treatment of liquid having already flowed through the lower separation chamber.

The centrifugal separator according to U.S. Pat. No. 2,488,747 could be improved by the use of members for entrainment of mixture supplied to the central inlet chamber of the rotor, which members are more gentle to the mixture than usually used entrainment members consisting of wings extending axially and radially within the inlet chamber. Thus, a technique described in U.S. Pat. No. 2,302,381 and U.S. Pat. No. 4,721,505 could be used, according to which mixture entering the inlet chamber is gently accelerated to the rotational speed of the rotor by means of smooth discs. In practice this could be accomplished in a way such that the radially inner portions of the separation discs in a centrifugal separator of the initially defined kind would be used for acceleration of entering mixture to the rotational speed of the rotor.

An advantage of an acceleration technique of this kind, as it is described in U.S. Pat. No. 4,721,505, is that the acceleration effect of the acceleration discs as used is automatically adapted to the magnitude of the flow with which mixture is introduced into the inlet chamber, a larger or smaller number of the acceleration discs being used. This feature, meaning in connection with relatively small flows of mixture entering the inlet chamber the spaces between part of the acceleration discs are only partly filled and are not being flowed through by the mixture, can not be accepted, however, in connection with a centrifugal separator of the initially defined kind. This would mean, namely, that in connection with a relatively small inflow of mixture entering the inlet chamber part of the spaces between the separations discs would not be used for separation.

The object of the present invention is to accomplish in a centrifugal separator of the initially described kind the use of the above described acceleration technique, the separation discs being used as acceleration discs in a way such that the whole separation chamber is used effectively even at relatively small inflow of mixture entering the inlet chamber.

This object is achieved by the features that the spaces between the separation discs are open towards and communicate directly with the inlet chamber around all of the rotor axis, and that at least some of the separation discs have axially extending through holes situated radially inside said outlets of the spaces between the separation discs and at a distance from the radially inner edges of the separation discs, that is smaller than the distance between the holes and the radially outer edges of the separation discs.

Thereby, mixture entrained in rotation may be distributed substantially evenly in the spaces between the separation discs even if part of these spaces are not filled with liquid up to the radially inner edges of the separation discs, i.e. cannot receive mixture directly from the central inlet chamber.

In a preferred embodiment of the invention the separation discs have plane portions in which the axially extending through holes are formed.

Figure 2:
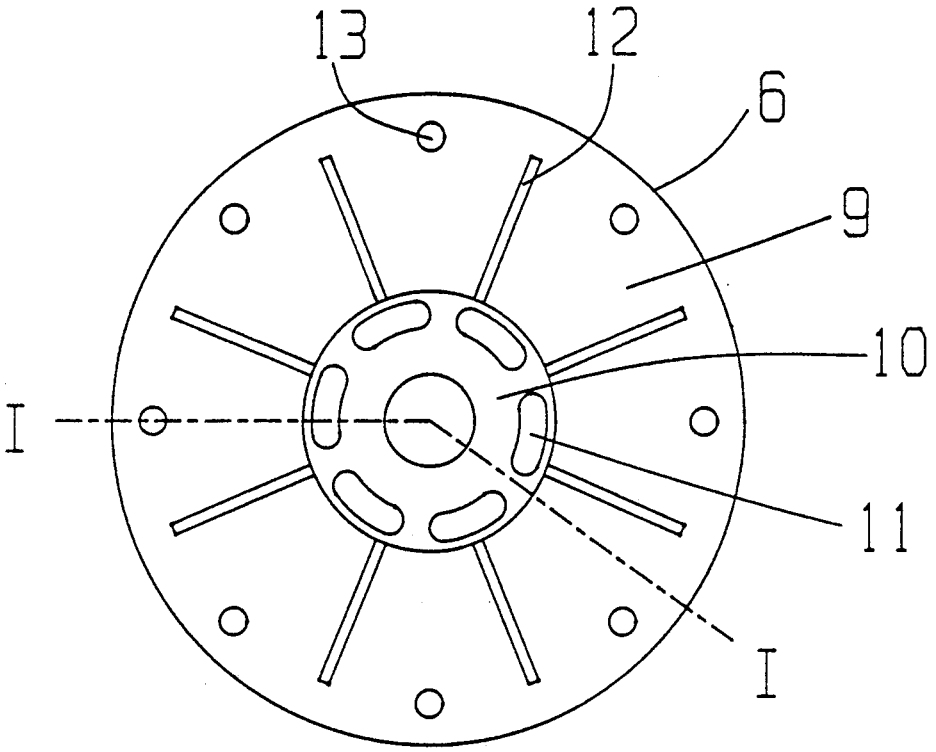
Figure 3:
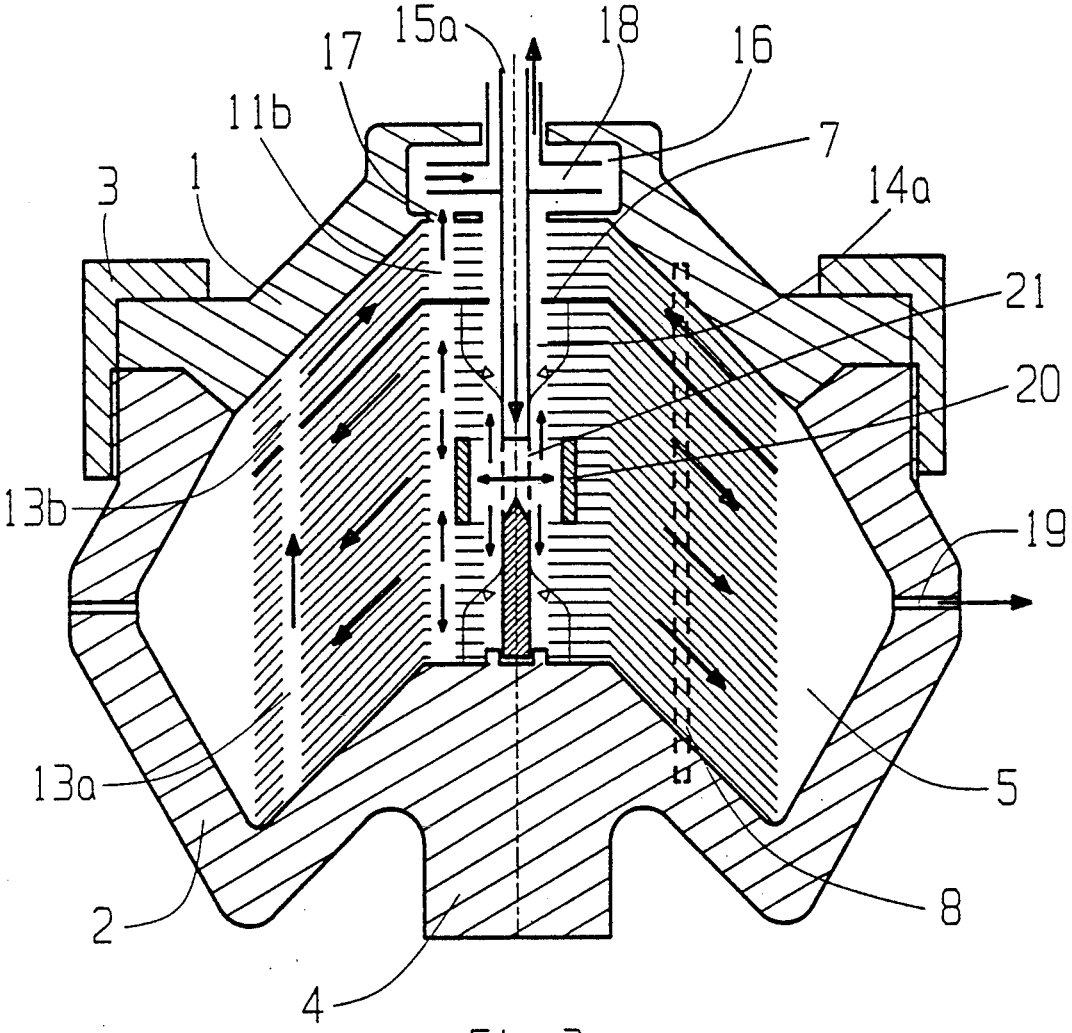

The invention is described in the following with reference to the accompanying drawing, in which FIG. 1 shows an axial section through a first embodiment of the centrifuge rotor according to the invention, FIG. 2 shows a partly conical separation disc, seen from above, of the kind used in the centrifuge rotor in FIG. 1, a section line I—I in FIG. 2 illustrating which axial section is to be seen in FIG. 1, and FIG. 3 shows an axial section through a second embodiment of a centrifuge rotor according to the invention.

FIG. 1 shows a centrifuge rotor comprising an upper part 1 and a lower part 2, which parts are axially kept together by means of a locking ring 3. The centrifuge rotor is supported by a drive shaft 4 connected with the lower rotor part 2.

The rotor parts 1 and 2 form a separation chamber 5, in which a stack of partly conical separation discs 6 is arranged coaxially with the rotor. The stack of separation discs 6 is divided by means of a partly conical partition 7 into an upper and a lower part, the functions of which parts are to be described later. The separation discs 6 as well as the partition 7 are fixed radially and circumferentially relative to each other and relative to the rotor by means of a number of rods 8, which extend axially through the whole stack of separation discs 6 and the partition 7 and which at their ends are connected with the rotor parts 1 and 2, respectively.

A separation disc 6 seen from above is shown in FIG. 2. It comprises a frusto-conical portion 9 and a central, annular, plane portion 10. The plane portion 10 has a ring of axially extending through holes 11 situated at a distance from the radially inner edge of the separation disc 6, that is substantially smaller than the distance between the holes 11 and the radially outer edge of the separation disc. As can be seen from FIG. 1 the holes 11 of the different separation discs 6 are situated axially aligned, so that axial channels are formed through the stack of separation discs. These channels are closed by the partition 7 which thus divides the channels in lower channel parts 11*a* and upper channel parts 11*b*.

As can be seen from FIG. 2, each separation disc on the upper side of its conical portion 9 has a number of conventionally formed radial spacing members 12. These are intended to abut against the underside of the conical portion 9 of an adjacent separation disc, so that radial flow channels are formed between the separation discs. No corresponding spacing members are present between the central plane portions 10 of the separation discs and, therefore, the spaces between these portions 10 are open in the circumferential direction of the rotor all the way around the rotor axis.

Each separation disc also has a number of through holes 13 close to its radially outer edge. As can be seen from FIG. 1, the holes 13 are situated in the separation discs axially aligned with each other and with corresponding holes in the partition 7, so that axial channels are formed through the whole of the stack of separation discs in the separation chamber 5. The parts of these channels situated below the partition 7 are in FIG. 1 designated 13*a*, whereas the upper parts of the same channels are designated 13*b*.

At the center of the stack of separation discs 6 there is formed an inlet chamber 14, which communicates radially outwards with the spaces between the plane portions 10 of the separation discs all the way around the rotor axis. A stationary inlet pipe 15 extends from outside of the rotor into the inlet chamber and opens in the lower part thereof, which is free from central plane separation disc portions 10.

In the upper rotor part 1 there is formed a radially inwards open annular outlet chamber 16, which through axial holes 17 communicates with the upper channel parts 11*b* in the separation chamber 5. A stationary outlet member 18, e.g. a so called paring member, is supported by the inlet pipe 15 and extends into the outlet chamber 16. There is a possibility for passage of air from the axially upper part of the inlet chamber 14 to the outside of the rotor.

Peripheral outlet openings 19 extend through the rotor part 2 from the radially outermost part of the separaton chamber 5 to the outside of the rotor.

The centrifuge rotor according to FIG. 1 is intended to operate in the following manner.

A liquid mixture of two components to be separated is supplied to the lower part of the inlet chamber 14 through the inlet pipe 15. From the opening of the inlet pipe 15 the mixture flows axially upwards in the inlet chamber 14 between the inlet pipe 15 and the radially inner edges of the separation discs 6. Gradually the mixture is distributed in the spaces between some the central plane portions 10 of the separation discs 6, in which spaces mixture while it moves radially outwards is gradually entrained in the rotor rotation by friction coming up between the mixture and the plane portions 10.

At a certain flow of mixture into the inlet chamber 14 there is formed therein a free liquid surface at a level shown in FIG. 1 by a full line and a triangle. Upon increase of the flow of mixture into the inlet chamber 14 the free liquid surface may move to a level illustrated by a dotted line and a triangle axially higher up in the inlet chamber.

As can be seen from FIG. 1, mixture flows into a larger number of spaces between central portions 10 of the separation discs in connection with the larger flow into the inlet chamber 14 than in connection with the smaller inflow. Not in any of the cases mixture flows into all of these spaces from the central part of the inlet chamber 14.

When mixture having entered the spaces between the central portions 10 of the separation discs has been entrained at least partly in the rotor rotation under certain radial movement within the spaces, the mixture is distributed axially over the part of the separation disc stack that is situated below the partition 7. This occurs through the channels 11*a* (FIG. 1). After that the mixture flows further on radially outwards between the separation discs below the partition 7, the different components of the mixture being separated from each other.

A relatively heavy component, e.g. solids, moves towards the undersides of the separation discs and slides radially outwards along these to the so called sludge space of the separation chamber 5 radially outside the separation discs. The heavy component leaves the rotor through the peripheral outlet openings 19.

Light component of the mixture gradually freed from heavy component flows radially outwards between the separation discs in layers closest to the upper sides of the discs, after which at least a larger part of the light component flows axially upwards through the channels 13*a* and further through the channels 13*b* in the stack of separation discs. Above the partition 7 the light component gradually flows radially into the spaces between the separation discs, in which it is subjected to a further separating operation. The light component leaves the separation chamber through the channels 11*b* and the openings 17 and flows further on through the outlet chamber 16 out through the stationary outlet member 18.

The reason why the mixture in the inlet chamber 14 first flows axially upwards between the inlet pipe 15 and the inner edges of the separation discs—and does not flow directly from the opening of the inlet pipe 15 out into the separation chamber through the spaces between the lowermost separation discs—is that the mixture does not rotate when it leaves the opening of the inlet pipe and, therefore, does not have a pressure as high as that of the rotating mixture present close to the conical portions of the lowermost separation discs in the lower part of the inlet chamber 14.

FIG. 3 shows an alternative embodiment of the invention. Details thereof having their exact counterparts in the embodiment according to FIG. 1 have been given the same numerals as in the last mentioned figure.

Most of the separation discs in FIG. 3 have the same design as the separation discs 6 in FIG. 2. However, a number of separation discs arranged at the center of the disc stack part situated below the partition 7 have a somewhat smaller central plane portion than the rest of the separation discs. This is to make it possible to arrange an internally smooth cylindrical sleeve 20 coaxially with the rotor just about in the middle of the inlet chamber 14*a*. The sleeve 20 has an outer diameter which corresponds substantially to the distance between adjacent edges of two opposite to each other situated holes 11 of a separation disc (see FIG. 2).

A stationary inlet pipe 15*a* extends axially into and through the whole of the inlet chamber 14*a*. In an area where it extends through the sleeve 20 the inlet pipe 15*a* has a number of inlet holes 21 for mixture to be treated in the rotor. The inlet pipe 15*a* is closed at its lower end, but a separate thin venting conduit (not shown) may extend through the inlet pipe from its lower end and out of the rotor for venting air from the lower part of the inlet chamber 14*a*.

Upon supply of mixture through the inlet pipe 15*a* the mixture flows through the holes 21 out into the space within the sleeve 20 and from there axially both upwards and downwards in the inlet chamber 14*a*. Gradually the mixture flows after that radially into and through the interspaces between the radially inner edges of the separation discs. In these interspaces the mixture is gradually entrained in the rotor rotation by friction coming up between the mixture and the plane portions of the separation discs.

When the mixture has been given a certain rotational speed and moved a distance radially, it is distributed over the whole stack of separation discs by axial flow through the holes 11 in the latter (see FIG. 2). Such axial flow also takes place in the area axially outside the sleeve 20. Free liquid surfaces are formed in the inlet chamber 14*a* as illustrated in FIG. 3 by full lines and triangles.

After the mixture has been distributed over the whole axial extension of the separations disc stack it flows further on radially outwards in the interspaces between the separation discs, and the course to follow corresponds to the one already described with reference to FIG. 1.

By means of an arrangement according to FIG. 3 it is possible to accomplish a satisfactory axial distribution of supplied mixture even in a very high stack of separation discs.

I claim:

1. Centrifugal separator comprising a rotor having a central inlet chamber (14) for a liquid mixture of components to be separated and a separation chamber (5) which surrounds the inlet chamber (14) and contains a stack of at least partly conical separation discs (6) arranged axially spaced from each other and coaxially with the rotor and having radially inner and radially outer edges, the spaces between the separation discs having inlets for mixture at the radially inner edges of the separation discs, which inlets communicate with said inlet chamber (14), and outlets for separated components radially outside the inlets, so that mixture as well as components separated therefrom are allowed to flow radially outwards between the separation discs during the operation of the rotor, characterized in that the spaces between the separation discs are open towards and communicate directly with the inlet chamber around the whole of the rotor axis, and that at least some of the separaton discs (6) have axially extending through holes (11) situated radially inside said outlets of the spaces between the separation discs and at a distance from the radially inner edges of the separation discs, that is smaller than the distance between the holes (11) and the radially outer edges of the separation discs.

2. Centrifugal separator according to claim 1, characterized in that the separation discs (6) have central plane portions (10).

3. Centrifugal separator according to claim 2, characterized in that the axially extending through holes (11) are formed in the plane portions (10) of the separation discs (6).

4. Centrifugal separator according to any of the preceding claims, characterized in that in the inlet chamber (14) between the axial ends thereof there is arranged an open ended cylindrical sleeve (20) coaxially with the rotor and radially inside said axially extending through holes (11) in the separation discs (6), an inlet pipe (15*a*) for the liquid mixture opening within the sleeve (20).

5. Centrifugal separator according to claim 4, characterized in that the sleeve (20) is substantially free of entrainment members on its inside.

* * * * *